United States Patent [19]

Puckett

[11] Patent Number: 4,974,350

[45] Date of Patent: Dec. 4, 1990

[54] BLADE/SCOOP UNIT FOR BULLDOZER

[76] Inventor: Juan E. Puckett, Box 1, Breaks, Va. 24607

[21] Appl. No.: 447,523

[22] Filed: Dec. 7, 1989

Related U.S. Application Data

[63] Continuation of Ser. No. 151,290, Feb. 1, 1988, abandoned.

[51] Int. Cl.[5] ..... E02F 3/76

[52] U.S. Cl. ..... 37/117.5; 37/DIG. 3; 172/438

[58] Field of Search ..... 37/2 R, 117.5, DIG. 3, 37/DIG. 12; 172/438

[56] References Cited

U.S. PATENT DOCUMENTS

| | | | |
|---|---|---|---|
| 4,372,063 | 2/1983 | Work | 37/117.5 X |
| 4,407,080 | 10/1983 | Mann | 37/117.5 |
| 4,566,844 | 1/1986 | Campin | 37/117.5 X |
| 4,807,689 | 4/1974 | Shovick | 37/2 R X |

*Primary Examiner*—Edgar S. Burr
*Assistant Examiner*—Moshe I. Cohen

[57] ABSTRACT

A dozer blade/scoop unit comprising a dozer blade, a mounting mechanism on the blade adapted to affix the same to the elevator arms of a dozer, a scoop having a floor and side walls, cooperating hinge mechanisms on the blade and on the scoop pivotally connecting the same, and a lever mechanism on the scoop adapted for connection to a pivot power mechanism whereby operation of the power mechanism will pivot the scoop on the blade to selectively position the floor of the scoop with respect to the blade.

15 Claims, 2 Drawing Sheets

BLADE/SCOOP UNIT FOR BULLDOZER

This application is a continuation of SN 151,290, filed Feb. 1, 1988, now abandoned.

This invention concerns earth moving equipment, especially bulldozers, hereinafter dozer, wherein a unique bucket or scoop accessory is provided for attachment to the dozer blade to greatly enhance the material moving versatility thereof.

Heretofore, dozers have been conventionally designed for and essentially limited to the operation of pushing earth and rocks and the like. Usually, this function is all that is required where the dozer is operating in concert with other specially designed equipment such as front loaders and other such lifting devices typically found on large construction sites such as road building. In other situations however, where such lifting devices are not readily available, the dozer is often called upon to perform material moving operations for which it is ill-adapted. Such operations include, e.g., the movement of particulate materials or heavy bulky objects from one location to another over rough or otherwise difficult terrain, or the movement of such materials out of locations having limited access, where the operation would be much better served, for example, by a scooping, lifting and transporting device.

The present invention has as a principal object therefore, to provide an attachment means which is readily and easily connected to a dozer blade to provide material scooping, lifting and transporting capability thereto, in addition to the inherent pushing capacity.

This and other objects hereinafter becoming evident have been attained in accordance with the present invention through the discovery of a dozer blade/scoop unit comprising dozer blade means, mounting means on said blade means adapted to affix the same to the elevator arms of a dozer, scoop means having floor means and side wall means, cooperating hinge means on said blade means and on said scoop means pivotally connecting the same, and lever means on said scoop means adapted for connection to pivot power means whereby operation of said power means will pivot said scoop means on said blade means to selectively position said floor means with respect to said blade means.

In preferred embodiments of the invention:

the hinge means axis lies adjacent the top of said blade means and is oriented substantially parallel to the horizontal axis thereof;

cooperating peg and sleeve alignment means are provided on said blade and scoop means for assisting in rapid and accurate connecting thereof;

said hinge means comprises bearing means positioned adjacent each end of said blade means and on each of said scoop side walls, said bearing means adapted to be aligned for the insertion of hinge pin means therethrough;

each lever means has a bell-crank shaped body member, one end of which provides the aforesaid peg alignment means, the other end of which provides a power arm adapted for connection to the pivot power means, and the vertex portion of which is provided with bearing means integral with said hinge means;

the pivotal axes of the bearing means of adjacent hinge means and lever means are aligned and employ common hinge pin means;

cooperating stop means are provided on said scoop means and said peg means for positioning said peg means in said sleeve means to align the bearing means of said blade means, scoop means, and lever means;

the power means comprises hydraulic cylinder means pivotally attached to said blade means and to the power arm of said lever means;

safety screen means is provided on said scoop means extending between said side wall means adjacent the rear upper surfaces thereof;

the blade mounting means is provided with tilt pivot means, and said blade means is adapted for connection to tilt power means on the dozer whereby desired tilt of said blade means is selectively provided;

the blade tilt is about the horizontal and/or the vertical axis of the blade;

the scoop comprises a substantially flat floor, a side wall affixed adjacent each longitudinal edge of said floor and extending upwardly therefrom, sleeve alignment means affixed to each of said side walls with their bore axes oriented essentially parallel to each other and substantially parallel to said longitudinal edges of said floor, and pivot bearing means affixed to each said side wall for pivotally mounting said scoop on said blade;

the scoop has planar safety screen means extending between said side walls at the rear, upper surfaces thereof with its plane oriented within the 90° angle defined by the floor means and the plane normal thereto;

the rear edge of said scoop floor lies substantially forward of said pivot bearing means; and each said side wall is generally upwardly tapered from front to rear, platform means is provided on the inner surface of each of said side walls adjacent the upper rear edges thereof and extends inwardly from each said side wall, and the sleeve means and pivot bearing means are affixed to said platform means.

The invention will be further understood by the following description and drawing wherein.

Figure 1:
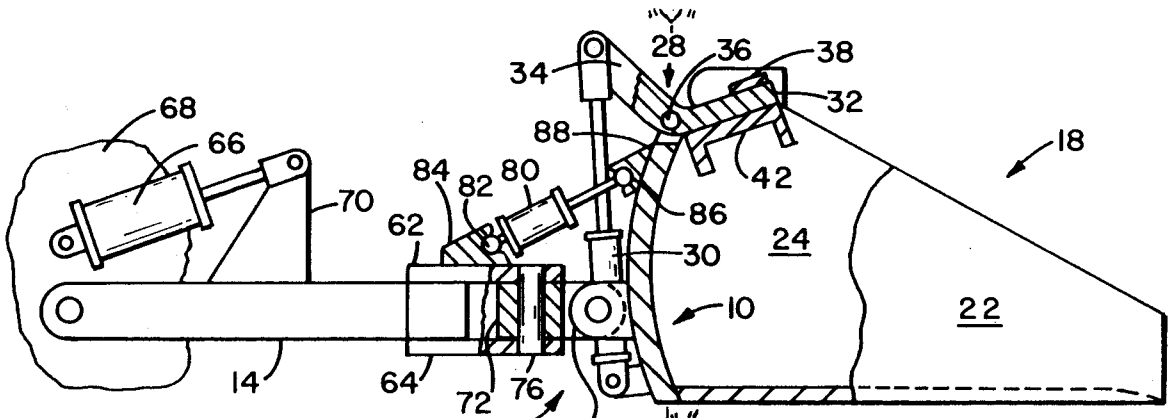
FIG. 1 is a side view, partly in section, of one embodiment of the present invention.

Referring to the drawing and with reference to claim 1, hereof, the dozer blade/scoop unit of the present invention comprises dozer blade means generally designated 10, mounting means generally designated 12 on said blade means adapted to affix the same to the elevator arms 14 and 16 of a dozer, scoop means generally designated 18 having floor means 20 and side wall means 22 and 24, cooperating hinge means generally designated 26 on said blade means and on said scoop means pivotally connecting the same, and lever means generally designated 28 on said scoop means adapted for connection to pivot power means 30 whereby operation of said power means will pivot said scoop means on said blade means to selectively position said floor means with respect to said blade means.

Figure 2:
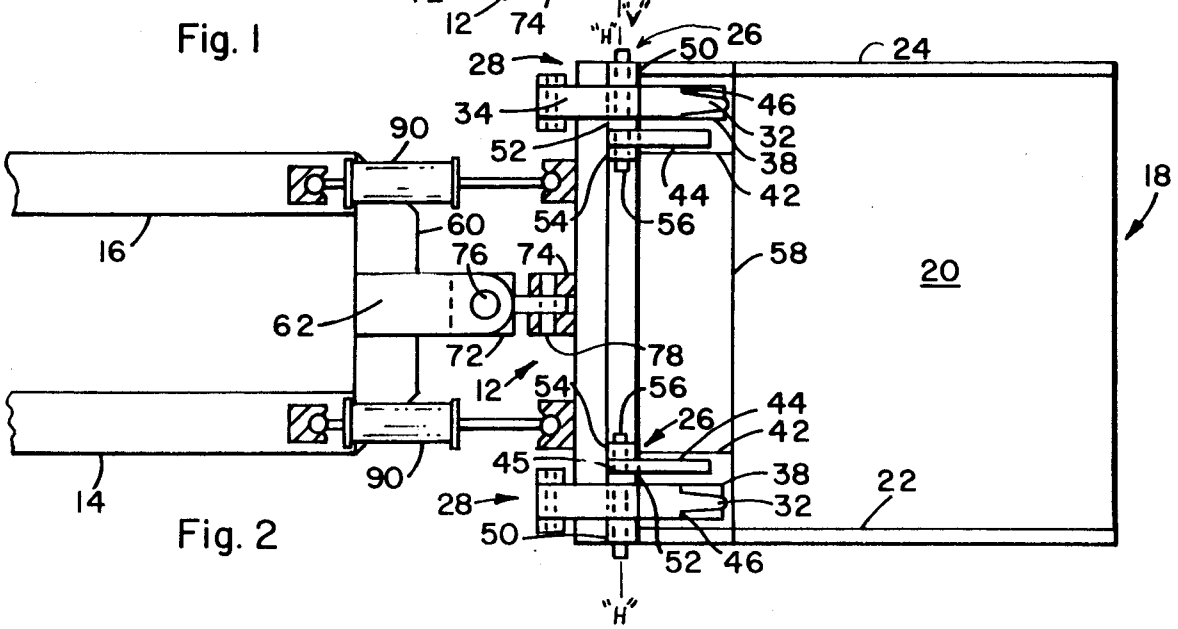
FIG. 2 is a top view, partly in section, of the embodiment of FIG. 1.
Figure 4:
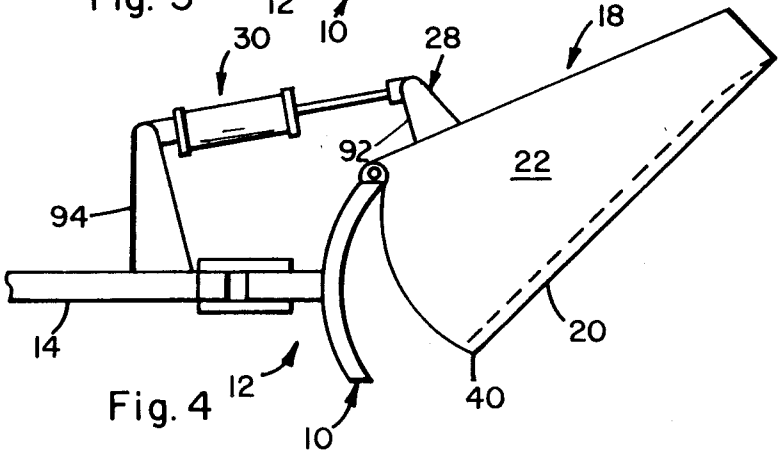
FIG. 4 is a view as in FIG. 3 with the pivot power means actuated and the scoop thus positioned in its dump position.

In the embodiment of the invention shown in FIGS. 1 and 2, the lever means 28 comprises a bell-crank shaped body member having one end section shaped to provide an alignment peg 32, the other end section providing a power arm 34, and the vertex providing a bearing 36. In association with this body member, the lever means further comprises a sleeve member 38 into which peg 32 is inserted and which serves to releasably affix the lever body member to the scoop such that pivoting of the power arm counterclockwise in the drawing will rotate the scoop to a position such as shown in FIG. 4 wherein the rear edge 40 of the floor is spaced from the blade to allow dumping of material from the scoop.

Figure 5:
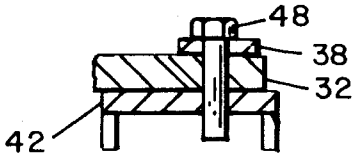
FIG. 5 is a partially cross-sectional view of an alternative alignment peg and sleeve construction.
Figure 6:
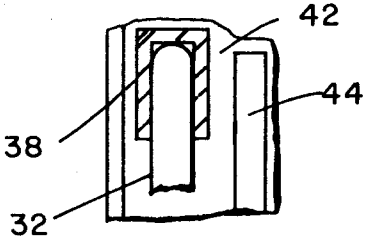
FIG. 6 is a cross-sectional view of a further alignment peg and sleeve construction having inherent peg stop and positioning means for proper hinge alignment.
Figure 3:
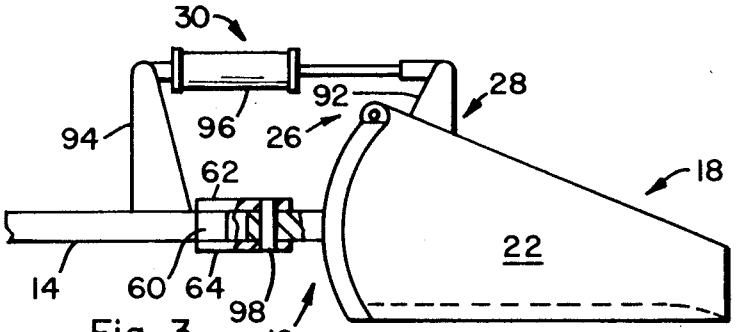
FIG. 3 is a reduced scale side view of an alternative embodiment of the present invention.

Referring further to FIGS. 2 and 3, each sleeve member 38 is conveniently provided by welding a generally tapered, ∩-shaped member to a platform 42 welded to the inside of each of walls 22 and 24. Also preferably welded to these platforms are members 44, the bearing apertures 45 of which align with bearings 36 when shoulders or stops 46 on pegs 32 abut the ends of the sleeves. These members 44 add to the rotative stability of the scoop but are not essential, particularly where as shown in FIG. 5, retaining pins or bolts 48 are employed which link together the sleeves 38, lever means 28 and platforms 42. Bearing blocks 50, 52 and 54 are provided on the top of the blade, preferably by welding, and in cooperation with removable hinge pins 56, pivotably secure the scoop to the blade. These pins are held in place by any suitable means such as cotter pins which also provide an easy means for removal of the pins and disconnection of the scoop from the blade.

The scoop pivot power is conveniently provided by hydraulic cylinders 30 pivotally attached to each end of the blade and to each power arm of the lever means. It is particularly noted at this point, that the structure shown in FIGS. 1 and 2 offers advantages which are not readily apparent. For example, the particular combination and placement of the lever means and pivot power means allows removal of the scoop without any more effort than to simply withdraw the hinge pins 56 until they clear bearings 45 and then back the dozer away from the scoop to withdraw pegs 32 from the sleeves. In the embodiment of FIG. 5, this disconnection is perhaps even simpler, i.e., removal of pins 48 and backing away of the dozer. In order for such construction to have maximum practicality however, the alignment pegs 32 and the other structure of the pivot means should be protected as far as possible from damaging contact with boulders and the like. Such protection is afforded by the present construction in that when the scoop is not attached to the blade, the alignment pegs 32 can be raised to an upright position which is essentially clear of the blade and its working surface, and is also clear of boulders or the like being pushed by the blade. Also, when the scoop is attached, the platforms 42 as well as heavy screen or shield 58 welded to and extending between the platforms, protect the lever means and pivot power means from most damaging contacts.

In the embodiment of FIGS. 1 and 2, the dozer elevator arms 14 and 16 are shown connected, for example, by welding or bolting at their forward ends to a crossbar 60 to which is similarly affixed tongue plates 62 and 64. These arms are raised or lowered in any conventional manner such as by hydraulic cylinders 66 connected at one end to the dozer body 68 and at the other end to advantage arm 70 attached to the elevator arms. As shown in these Figures, a universal joint may be provided to allow an essentially unlimited range of adjustments of the blade position. This joint comprises the tongue plates 62 and 64, intermediate block 72 and blade mount 74. The universal motion is provided by vertical pin 76 and horizontal pin 78 in known manner. The adjustment and posture of the blade about the horizontal axis "H" of the blade is maintained by means of hydraulic cylinder 80 (shown only in FIG. 1), the mounting of which is given the necessary freedom of motion by means of ball and socket joints 82, 84 and 86, 88 of any conventional construction, wherein 84 is welded, e.g., to plate 62, and 88 is welded to the blade. Likewise, adjustment of the blade about its vertical axis "V" is provided by hydraulic cylinders 90 (shown only in FIG. 1) mounted on the dozer elevator arms and blade by ball and socket joints equivalent to 82, 84 and 86, 88 described above. It is noted, that the ball and socket joints on the elevator arms are preferably elevated to allow downward pivoting of cylinders 90 when the blade is given a clockwise tilt rotation as viewed in FIG. 1.

In the embodiment shown in FIGS. 3 and 4, the lever means 28 is greatly simplified, however, this construction requires the pivot power means 30 to be disconnected either at the scoop end or the dozer end. In exemplary structure of this embodiment, lever arms 92 are welded to the scoop sides at any convenient location, and advantage arms 94 are welded to the elevator arms at any convenient location. The hydraulic cylinder 96 is attached to arms 92 and 94, preferably by universal type joints such that blade position adjustment about its vertical axis can be made without mechanical resistance from the cylinder 96 mounts.

In the embodiment of FIGS. 3 and 4, only blade adjustment about its vertical axis is shown by means of vertical pivot pin 98, however, universal pivotal action can also be provided. It is noted that blade posture adjustment is not made about the precise vertical and horizontal axes "V" and "H" as shown, since the actual pivot axes run through the pivot pins 76, 78 and 98, however, the net effect of the tilt is essentially the same.

The invention has been described in detail with particular reference to preferred embodiments thereof, but it will be understood that variations and modifications will be effected within the spirit and scope of the invention.

I claim:

1. A convertible dozer blade/scoop unit comprising dozer blade means mounted on a dozer for at least vertical adjustment with respect to ground level, lever means pivotally mounted on an upper portion of said blade means for rotation about a pivot axis lying substantially along and substantially parallel to the top of said blade means, power means on said dozer and affixed to said lever means for rotating the same about said axis, scoop means having floor means and side wall means, said floor means extending substantially the full width of said blade means, said side wall means having rearward portions extending substantially the full height of said blade means, and cooperating quick disconnect coupling means on said lever means and on an upper portion of said scoop means, said coupling means comprising peg means and sleeve means, either of which peg or sleeve means being integral with said lever means and the other being integral with said scoop means, whereby upon insertion of said peg means into said sleeve means said scoop means becomes pivotally affixed to said blade means and pivotal about the pivotal axis of said lever means, said coupling means in cooperation with said lever means and said power means being adapted to maintain said scoop floor means and the bottom of said blade means in substantially juxtaposed relationship during the scooping operation, and in a spaced relationship during the unloading operation of said unit.

2. The unit of claim 1 wherein aperture means are provided in said sleeve means and peg means and adapted for alignment upon full insertion of said peg means in said sleeve means for receiving quickly removable locking pin means.

3. The unit of claim 1 wherein the insertion axis of each of said peg and sleeve means is substantially parallel to substantially level terrain for allowing rapid and accurate insertion of said peg means into said sleeve means by normal movement of the dozer toward said scoop means with said blade means in coupling position.

4. The unit of claim 1 wherein said lever means comprises two or more bell-crank shaped body members, one end of each of which provides said peg means, the other end of each of which provides a power arm adapted for connection to said power means, and wherein the vertex portion of each said body member provides the pivotal mounting therefor.

5. The unit of claim of 4 wherein cooperating supplementary hinge segments are provided on said blade means and said scoop means, the pivotal axes of said segments being adapted for alignment with the pivotal axis of said lever means to receive a common hinge pin means.

6. The unit of claim 5 wherein cooperating stop means are provided on said sleeve means and said peg means for positioning said peg means within said sleeve means to align all of said pivotal axes.

7. The unit of claim 4 wherein said power means comprises hydraulic cylinder means pivotally attached to said blade means and to said power arm of said lever means.

8. The unit of claim 1 wherein safety screen means is provided on said scoop means extending between said side wall means adjacent the rear upper surfaces thereof.

9. The unit of claim 1 wherein said blade means is provided with tilt pivot means, and said blade means is adapted for connection to tilt power means on the dozer whereby desired tilt of said blade means is selectively provided.

10. The unit of claim 9 wherein the blade tilt is about the horizontal and/or the vertical axis of said blade means.

11. A bulldozer having blade means affixed to dozer elevator arm means, a scoop having a generally rectangular floor, side wall means extending upwardly from each side edge of said floor, lever means pivotally mounted about a pivotal axis on an upper portion of said blade means and connected to pivot power means mounted on said blade means, quick disconnect coupling means comprising peg means and sleeve means, either of which peg or sleeve means being integral with said lever means and the other being integral with said scoop, whereby upon insertion of said peg means into said sleeve means said scoop becomes pivotally affixed to said blade means and pivotal about the pivotal axis of said lever means whereby operation of said power means will pivot said lever means and said scoop on and relative to said blade means to selectively position said floor with respect to said blade means for the loading or unloading of said scoop.

12. The bulldozer of claim 11 wherein cooperating supplementary hinge segment means are positioned adjacent each end of said blade means and adjacent each of said scoop side walls, the bearing apertures of which are adapted to be aligned for the insertion of hinge pin means therethrough upon full insertion of said peg means in said sleeve means.

13. The bulldozer of claim 11 wherein said lever means comprises multiple levers, each of which has a bell-crank shaped body member, one end of which provides the aforesaid peg means, and the other end of which provides a power arm connected to said pivot power means, and wherein the vertex portions of said body members provide pivotal bearing means.

14. The bulldozer of claim 11 wherein said peg and sleeve means are provided with mating tapers for rapidly aligning and positioning said blade and scoop means.

15. The bulldozer of claim 11 wherein the pivot power means comprises hydraulic cylinder means pivotally attached to said blade means and to said lever means.

* * * * *